US010244333B2

(12) United States Patent
Mustiere et al.

(10) Patent No.: US 10,244,333 B2
(45) Date of Patent: Mar. 26, 2019

(54) METHOD AND APPARATUS FOR IMPROVING SPEECH INTELLIGIBILITY IN HEARING DEVICES USING REMOTE MICROPHONE

(71) Applicant: Starkey Laboratories, Inc., Eden Prairie, MN (US)

(72) Inventors: Frederic Philippe Denis Mustiere, Chaska, MN (US); Jumana Harianawala, Eden Prairie, MN (US); Tao Zhang, Eden Prairie, MN (US)

(73) Assignee: Starkey Laboratories, Inc., Eden Prairie, MN (US)

( * ) Notice: Subject to any disclaimer, the term of this patent is extended or adjusted under 35 U.S.C. 154(b) by 0 days.

(21) Appl. No.: 15/174,027

(22) Filed: Jun. 6, 2016

(65) Prior Publication Data

US 2017/0353805 A1 Dec. 7, 2017

(51) Int. Cl.
*G10L 21/0208* (2013.01)
*H04R 1/10* (2006.01)
(Continued)

(52) U.S. Cl.
CPC ..... *H04R 25/505* (2013.01); *G10L 21/0208* (2013.01); *H04R 3/005* (2013.01);
(Continued)

(58) Field of Classification Search
CPC .. H04R 25/552; H04R 25/407; H04R 25/554; H04R 3/005; H04R 25/505; H04R 25/70;
(Continued)

(56) References Cited

U.S. PATENT DOCUMENTS 5,721,783 A 2/1998 Anderson
7,313,241 B2 12/2007 Hamacher et al.
(Continued)

FOREIGN PATENT DOCUMENTS

EP 1715723 A2 * 10/2006 ..... H04R 25/552
EP 2040486 A2 3/2009
(Continued)

OTHER PUBLICATIONS

"European Application Serial No. 17174614.2, Extended European Search Report dated Oct. 6, 2017", 12 pgs.
(Continued)

*Primary Examiner* — Curtis A Kuntz
*Assistant Examiner* — Julie X Dang
(74) *Attorney, Agent, or Firm* — Schwegman Lundberg & Woessner, P.A.

(57) ABSTRACT

A hearing system includes a pair of first and second hearing devices wirelessly coupled to a remote device that includes a microphone. One or more gains can each be calculated as a function of a first microphone signal received from the first hearing device, a second microphone signal received from the second hearing device, and a remote microphone signal received from the remote device. The function can be designed to improve speech intelligibility in a noisy environment. The one or more gains are applied to the first and second microphone signals to produce output sounds by the first and second hearing devices.

20 Claims, 5 Drawing Sheets

(51) Int. Cl.
*H04R 3/00* (2006.01)
*H04R 25/00* (2006.01)

(52) U.S. Cl.
CPC ..... *H04R 25/407* (2013.01); *H04R 25/43* (2013.01); *H04R 25/552* (2013.01); *H04R 25/554* (2013.01); *H04R 1/1083* (2013.01); *H04R 25/558* (2013.01); *H04R 2225/43* (2013.01); *H04R 2225/55* (2013.01); *H04R 2420/01* (2013.01); *H04R 2420/07* (2013.01)

(58) Field of Classification Search
CPC ..... H04R 2225/43; H04R 25/558; H04R 2225/021; H04R 2225/41; H04R 1/406; H04R 2225/67; H04R 25/405; H04R 25/606
USPC ..... 381/315
See application file for complete search history.

(56) References Cited

U.S. PATENT DOCUMENTS

2003/0198356 A1* 10/2003 Thompson ..... H04R 3/005 381/92
2003/0198357 A1* 10/2003 Schneider ..... G10L 21/0208 381/94.2
2005/0058313 A1* 3/2005 Victorian ..... H04R 25/554 381/315
2005/0254639 A1* 11/2005 Rodriguez ..... H04M 1/6008 379/388.04
2006/0245610 A1* 11/2006 Chalupper ..... H04R 25/70 381/321
2010/0111338 A1* 5/2010 Ypma ..... H04R 25/552 381/314
2010/0225479 A1* 9/2010 Maruoka ..... H04R 25/505 340/540
2011/0044481 A1* 2/2011 Marquis ..... H04R 25/405 381/313
2011/0257958 A1* 10/2011 Kildevaeld ..... G06F 3/0488 703/23
2012/0250915 A1* 10/2012 Takagi ..... H04R 25/353 381/312
2013/0208933 A1* 8/2013 Schmitt ..... H04R 25/70 381/317
2014/0010397 A1* 1/2014 Merks ..... H04R 25/407 381/330
2014/0016805 A1* 1/2014 Takagi ..... H04R 25/50 381/312
2014/0348331 A1 11/2014 Gran et al.
2014/0348359 A1* 11/2014 Woods ..... H04R 25/552 381/317
2015/0043765 A1* 2/2015 Merks ..... H04R 25/407 381/317
2015/0049892 A1 2/2015 Petersen et al.
2015/0334493 A1* 11/2015 Burns ..... H04R 25/552 381/23.1
2016/0112811 A1* 4/2016 Jensen ..... H04R 5/033 381/17
2017/0004845 A1* 1/2017 Verhaeghe ..... G06F 3/165
2017/0279427 A1* 9/2017 Chu ..... H03G 3/3005

FOREIGN PATENT DOCUMENTS

EP 2584794 A1 * 4/2013 ..... G09B 21/04
EP 2584794 A1 4/2013
EP 2704452 A1 3/2014
EP 2744229 A2 * 6/2014 ..... H04R 25/552
EP 2897384 A2 7/2015
EP 3016408 A1 5/2016
EP 3169085 A1 * 5/2017
WO WO-9534983 A1 12/1995
WO WO-2006021555 A1 3/2006
WO WO-2007128825 A1 11/2007
WO WO-2008052576 A1 5/2008

OTHER PUBLICATIONS

Srinevasan, Sriram, "Using a Remotewireless Microphone for Speech Enhancement in Nonstationary Noise", ICASSP 2011, (2011), 5088-5091.

* cited by examiner

METHOD AND APPARATUS FOR IMPROVING SPEECH INTELLIGIBILITY IN HEARING DEVICES USING REMOTE MICROPHONE

TECHNICAL FIELD

This document relates generally to hearing systems and more particularly to a method and system for providing binaural hearing devices with improved speech intelligibility using a remote microphone.

BACKGROUND

Hearing devices provide sound for the wearer. Some examples of hearing devices are headsets, hearing aids, speakers, cochlear implants, bone conduction devices, and personal listening devices. Hearing aids provide amplification to compensate for hearing loss by transmitting amplified sounds to their ear canals. Damage of outer hair cells in a patient's cochlea results in loss of frequency resolution and temporal resolution in the patient's auditory perception. As this condition develops, it becomes difficult for the patient to distinguish speech from environmental noise. Simple amplification does not address such difficulty. Thus, there is a need to help such a patient in understanding speech in a noisy environment.

SUMMARY

A hearing system includes a pair of first and second hearing devices wirelessly coupled to a remote device that includes a microphone. One or more gains can each be calculated as a function of a first microphone signal received from the first hearing device, a second microphone signal received from the second hearing device, and a remote microphone signal received from the remote device. The function can be designed to improve speech intelligibility in a noisy environment. The one or more gains are applied to the first and second microphone signals to produce output sounds by the first and second hearing devices.

In an exemplary embodiment, a hearing system includes a pair of first and second hearing devices and a remote device. The first hearing device includes a first microphone to produce a first microphone signal. The second hearing device includes a second microphone to produce a second microphone signal. The remote device includes a remote microphone to produce a remote microphone signal. Control circuitry is implemented in the first and second hearing devices to receive the first microphone signal, the second microphone signal, and the remote microphone signal, calculate a gain using the first microphone signal, the second microphone signal, and the remote microphone signal, apply the gain to the first microphone signal to produce a first output signal, and apply the gain to the second microphone signal to produce a second output signal.

In an exemplary embodiment, a hearing system includes a pair of first and second hearing devices and a remote device. The first hearing device includes a first microphone, a first controller, a first receiver, and a first communication circuit. The first microphone receives a first sound and produce a first microphone signal using the first sound. The first controller calculates a first gain being a first gain function of the first microphone signal, a second microphone signal, and a remote microphone signal, and produces a first output signal by applying the first gain to the first microphone signal. The first receiver produces a first output sound using the first output signal. The first communication circuit receives the second microphone signal and the remote signal. The second hearing device is wirelessly coupled to the first hearing device and includes a second microphone, a second controller, a second receiver, and a second communication circuit. The second microphone receives a second sound and produce a second microphone signal using the second sound. The second controller calculates a second gain being a second gain function of the first microphone signal, the second microphone signal, and the remote microphone signal, and produces a second output signal by applying the second gain to the second microphone signal. The second receiver produces a second output sound using the second output signal. The second communication circuit receives the first microphone signal and the remote signal. The remote device is wirelessly coupled to the first and second hearing devices and includes a remote microphone and a remote communication circuit. The remote microphone receives a remote sound and produces the remote microphone signal using the remote sound. The remote communication circuit transmits the remote microphone signal.

In an exemplary embodiment, a method for operating a pair of first and second hearing devices is provided. A first microphone signal is received from a first microphone in the first hearing device. A second microphone signal is received from a second microphone in the second hearing device. A remote microphone signal is received from a remote device wirelessly coupled to the pair of first and second hearing devices. A first gain and a second gain are determined based on the first microphone signal, the second microphone signal, and the remote microphone signal. The first gain is applied to the first microphone signal to produce a first output signal. The second gain is applied to the second microphone signal to produce a second output signal.

This summary is an overview of some of the teachings of the present application and not intended to be an exclusive or exhaustive treatment of the present subject matter. Further details about the present subject matter are found in the detailed description and appended claims. The scope of the present invention is defined by the appended claims and their legal equivalents.

DETAILED DESCRIPTION

Figure 1:
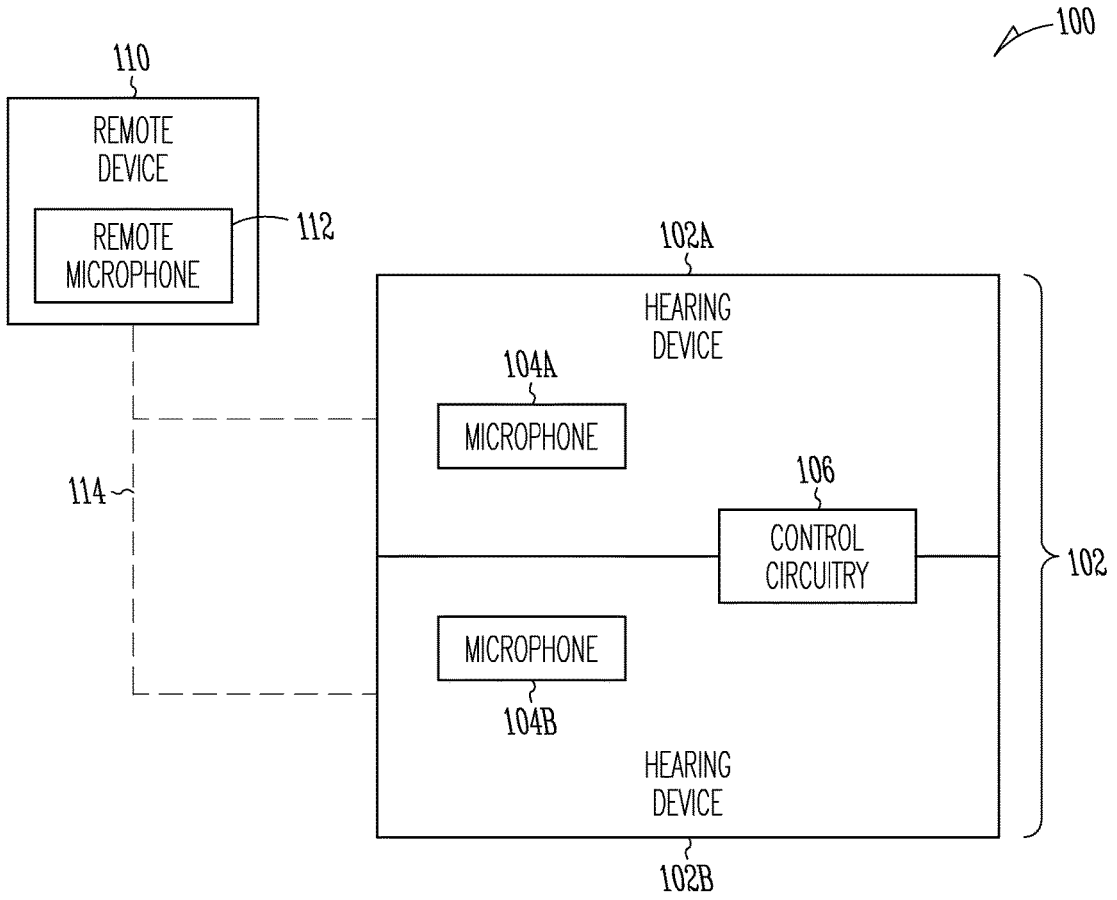
FIG. 1 is a block diagram illustrating an exemplary embodiment of a hearing system including a three-microphone network.

The following detailed description of the present subject matter refers to subject matter in the accompanying drawings which show, by way of illustration, specific aspects and embodiments in which the present subject matter may be practiced. These embodiments are described in sufficient detail to enable those skilled in the art to practice the present subject matter. References to "an", "one", or "various" embodiments in this disclosure are not necessarily to the same embodiment, and such references contemplate more than one embodiment. The following detailed description is demonstrative and not to be taken in a limiting sense. The scope of the present subject matter is defined by the appended claims, along with the full scope of legal equivalents to which such claims are entitled.

This document discusses, among other things, a hearing system that can improve speech intelligibility for binaural hearing devices, such as hearing aids, using a microphone that is remote from the hearing devices. In various embodiments, the present subject matter can provide binaural hearing devices with efficient and robust intelligibility improvement using a single remote microphone for preserving spatial cues. While application in binaural hearing aids is discussed as an example, the method and system for improving speech intelligibility as discussed in this document can be used in any binaural hearing devices that are capable of communicating with a remote device that includes a microphone.

A hearing system may include a network of hearing aids and remote devices communicating with the hearing aids. The remote devices may include microphones and transmit signals output from the microphones to the hearing aids. Examples of such remote devices include cellphones and wireless microphones (e.g., FM microphones). In this document, a "remote microphone" includes a microphone in such a remote device.

When a pair of hearing aids is worn by a wearer in a noisy environment, if a remote microphone is available and closer to a target speech source such as a conversational partner, the signal-to-noise ratio (SNR) at the remote microphone can be substantially higher that the SNR at the microphone of each hearing aid. In an example, signals captured by the remote microphone are streamed directly to the hearing aids. This provides a simple approach to speech intelligibility improvement by using the microphone signal with the higher SNR. However, an undesirable issue associated with this approach comes from the fact that the signal from the remote microphone replaces the output audio of the two hearing aids, resulting in loss of binaural cues. The disturbance or loss of binaural cues has a detrimental effect on speech intelligibility and listening comfort of the wearer. Additionally, the sound received by the remote microphone may reach the ears of the wearer after a significantly delay due to the wireless transmission delay in some systems.

In another example, research has been conducted with ad-hoc microphone arrays, where each microphone in a hearing system is seen as a node in a network of microphones on which beamforming solutions such as linearly constrained minimum variance (LCMV) (possibly distributed) are applied. However, there are still many practical roadblocks before this ad-hoc LCMV approach can be implemented in a hearing aid. Examples of such roadblocks include real-time robust estimation of the relative transfer functions of each interfering talker to the microphones, accurate synchronization at each node, and feasible schemes for distributed processing or large computational load at the hearing aid. In addition, binaural cue preservation is still an open issue with the ad-hoc microphone arrays.

The present subject matter can bring the audio magnitude spectra of the hearing aids closer to the audio magnitude spectrum at the remote microphone. To achieve this, one or more binaural gains can be determined to minimize a certain binaural distance between the magnitude of the audio signal at the remote microphone and the magnitude of the corrected audio signals at the microphones of the hearing aids. In various embodiments, the overall system can be set up to avoid or minimize perceivable delay effects, in that the latest binaural gain (calculated from the latest arriving wireless audio) is still applied to the most recent audio signal. A delay of up to 50 milliseconds was found to be substantially unperceivable by the wearer of the hearing aids in noisy environments.

When compared to other approaches for improving speech intelligibility using one or more remote microphones, the present subject matter can provide for a simpler system that has capability to fully preserve binaural cues and robustness to wireless transmission delays. Subjective tests have indicated a significant preference towards the present system rather than listening to only noisy signals delivered by hearing aids. When compared to the ad-hoc LCMV approach, the present system does not require knowledge of relative transfer functions, and requires very little computational overhead at the hearing aids. In addition, state-of-the-art LCMV techniques can only readily preserve spatial cues for the target sound source, but not for the interferences or noise. The present system can fully preserve the interaural time and level differences with respect to targeted sounds and interferences. When compared to listening to the signal streamed from the remote microphone only, the present system can offer significant advantages including binaural cue preservation and less transmission delay.

FIG. 1 is a block diagram illustrating an exemplary embodiment of a hearing system 100 including a three-microphone network. System 100 can include a binaural hearing device set 102 and a remote device 110. Remote device 110 can be communicatively coupled to hearing device set 102 via one or more wireless communication links 114. Hearing device set 102 can include a hearing device 102A and a hearing device 102B for being worn on or about the ears of a listener. Hearing device 102A can include a microphone 104A to produce a first microphone signal. Hearing device 102B can include a microphone 102B to produce a second microphone signal. Remote device 110 can include a remote microphone 112 to produce a remote microphone signal. Microphones 104A, microphone 104B, and remote microphone 112 can form the three-microphone network, and control circuitry 106 controls its operation. In various embodiments, the three-microphone network can be a synchronized three-mode system.

Control circuitry 106 includes a first portion 106A implemented in hearing device 102A and a second portion 106B implemented in hearing device 102B. In various embodiments, control circuitry 106 can be partitioned into portions 106A and 106B in various ways depending on design considerations. Control circuitry 106 can receive the first microphone signal, the second microphone signal, and the remote microphone signal, and can calculate one or more gains each being a function of the first microphone signal, the second microphone signal, and the remote microphone signal. Control circuitry 106 can apply the calculated one or more gains to the first and second microphone signals to produce first and second output signals. In various embodiments, control circuitry 106 can calculate a common gain and apply the common gain to the first microphone signal to produce the first output signal and apply the common gain to the second microphone signal to produce the second output signal. In various other embodiments, control circuitry 106 can calculate first and second gains that can have different values, apply the first gain to the first microphone signal to produce the first output signal, and apply the second gain to the second microphone signal to produce the second output signal. Having different first and second gains may not allow for preservation of interaural level differences, but can simplify the system because there is no need to synchronize sampling clocks that are used to sample the first and second microphone signals. In various embodiments, hearing device 102A can produce a first output sound based on the first output signal and transmit the first output sound to an ear of the listener. The hearing device 102A can further produce a second output sound based on the second output signal and transmit the second output sound to the other ear of the listener.

Hearing devices 102A and 102B can be communicatively coupled to each other via a binaural wireless communication link. In an exemplary embodiment, remote device 110 can stream the remote microphone signal to each of the hearing devices 102A and 102B. Hearing devices 102A and 102B can each receive the first microphone signal, the second microphone signal, and the remote microphone, and can further calculate the gain. In another exemplary embodiment, remote device 110 can stream the remote microphone signal to hearing devices 102A. Hearing device 102A can also receive the second microphone signal from hearing device 102B and then calculate the gain and transmit the gain to hearing device 102B.

In an exemplary embodiment, hearing device 102A is configured to be worn on or about the left ear of the listener to deliver the first output sound to the left ear. Hearing device 102B is configured to be worn on or about the right ear of the listener to deliver the second output sound to the right ear. In another exemplary embodiment, hearing device 102A is configured to be worn on or about the right ear of the listener to deliver the first output sound to the right ear. Hearing device 102B is configured to be worn on or about the left ear of the listener to deliver the second output sound to the left ear.

Remote device 110 can be implemented in any device that includes a microphone and is capable of communicating with the hearing device set 102, including transmitting the output signal of the microphone to the hearing device set 102. Examples of potential remote devices include, but are not limited to, cellphones, tablet computers, laptop computers, wireless microphones, wireless streaming devices with microphones, and other remote devices with microphone inputs.

Figure 2:
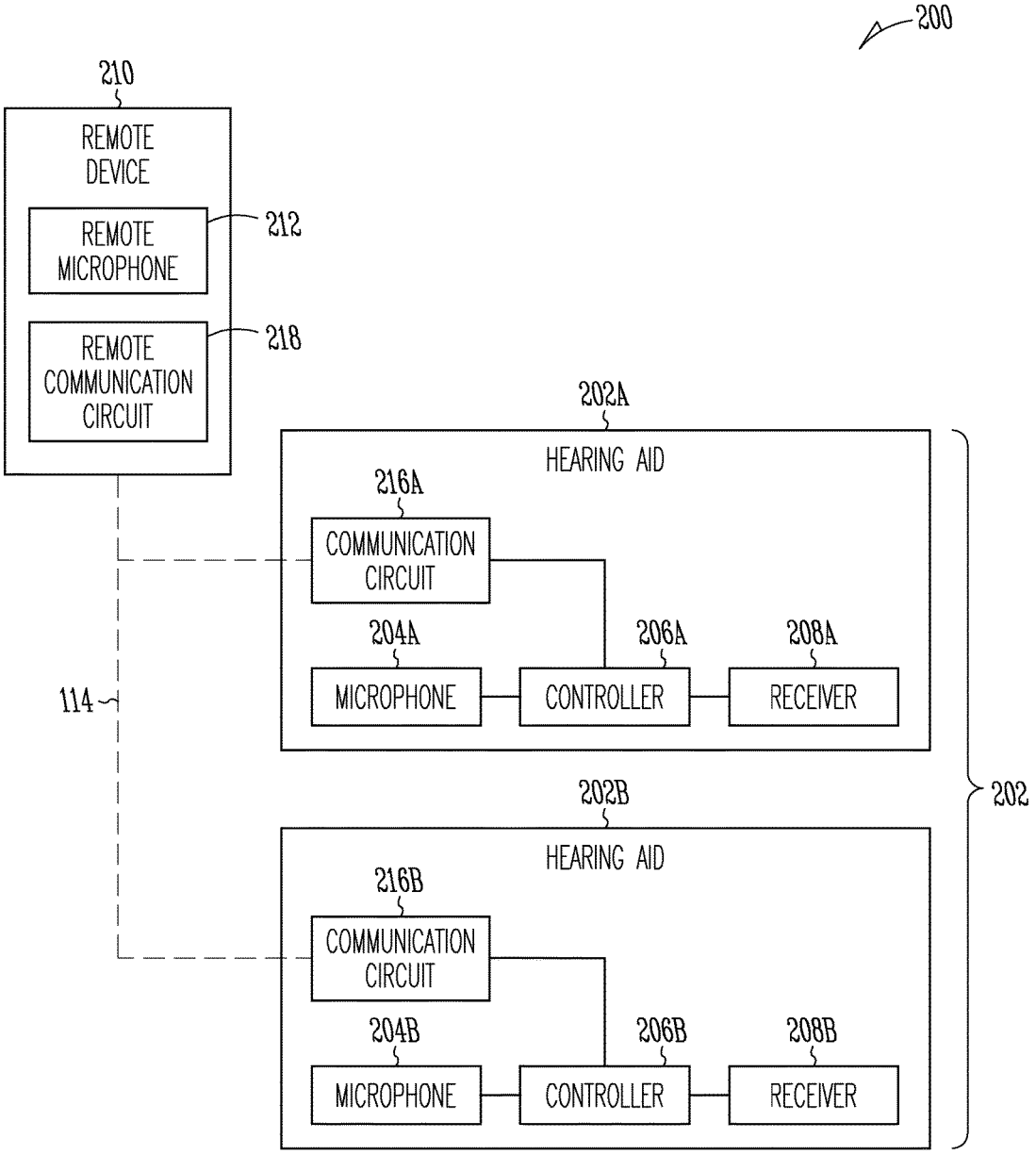
FIG. 2 is a block diagram illustrating of an exemplary embodiment of a hearing system including a pair of hearing aids and a remote device.

FIG. 2 is a block diagram illustrating an exemplary embodiment of a hearing system 200. Hearing system 200 is an exemplary embodiment of system 100 and includes a binaural hearing aid set 202 and a remote device 210 that is communicatively coupled to hearing aid set 202 via wireless link(s) 114. Hearing aid set 202 can include hearing aid 202A and hearing aid 202B. In an exemplary embodiment, hearing aid 202A is configured to be worn on or about the left ear of the listener (hearing aid wearer), and hearing aid 202B is configured to be worn on or about the right ear of the listener. In another exemplary embodiment, hearing aid 202A is configured to be worn on or about the right ear of the listener, and hearing aid 202B is configured to be worn on or about the left ear of the listener.

Hearing aid 202A represents an exemplary embodiment of hearing device 102A and includes a microphone 204A, a controller 206A, a receiver 208A, and a communication circuit 216A. Microphone 204A can receive a first sound and produce a first microphone signal using the first sound. Controller 206A can produce a first output signal by applying a first gain to the first microphone signal. Receiver 208A can produce a first output sound using the first output signal, and transmit the first output sound to an ear of the listener. Communication circuit 216A allows hearing aid 202A to wirelessly communicate with hearing aid 202B and/or remote device 210.

Hearing aid 202B represents an exemplary embodiment of hearing device 102B and includes a microphone 204B, a controller 206B, a receiver 208B, and a communication circuit 216B. Microphone 204B can receive a second sound and produce a second microphone signal using the second sound. Controller 206A can produce a second output signal by applying a second gain to the second microphone signal. Receiver 208A can produce a second output sound using the second output signal, and transmit the second output sound to the other ear of the listener. Communication circuit 216B allows hearing aid 202B to wirelessly communicate with hearing aid 202A and/or remote device 210.

In various embodiments, controller 206A can process the first microphone signal before applying the first gain to the first microphone signal, and controller 206B can process the second microphone signal before applying the second gain to the first microphone signal. In an exemplary embodiment, controller 206A includes a weighted overlap-add (WOLA) filter bank to filter the first microphone signal, and applies the first gain to the filtered first microphone signal. Controller 206B includes a WOLA filter bank to filter the second microphone signal, and applies the second gain to the filtered second microphone signal. In various embodiments, the WOLA filter structures can be such as those described in "Multirate Digital Signal Processing," by Ronald E. Crochiere and Lawrence R. Rabiner (copyright 1983), which is hereby incorporated by reference in its entirety. (See for example, inter alia, Chapter 7, section 7.2.5.)

Remote device 210 represents an exemplary embodiment of remote device 110 and includes a remote microphone 212 and a remote communication circuit 218. Remote microphone 212 can receive a remote sound and produce a remote microphone signal using the remote sound. Remote communication circuit 218 allows remote device 210 to wirelessly communicate with hearing aid 202A and/or hearing aid 202B.

In various embodiments, microphone 202A and microphone 202B can be substantially identical microphones. In various embodiments, microphone 202A and microphone 202B can have substantially matched microphone characteristics. Microphone 204A has first microphone characteristics including a first response function being a ratio of the first microphone signal to the first sound. Microphone 204B has second microphone characteristics including a second response function being a ratio of the second microphone signal to the second sound. The first response function and the second response function are ideally identical and can be substantially matched in practice. In various embodiments, remote microphone 212 can have a remote response function that is a ratio of the remote microphone signal to the remote sound and substantially matches the substantially matched first and second response functions. In various embodiments, remote microphone 212 can be calibrated or filtered to have the remote response function substantially matching the substantially matched first and second response functions.

In various embodiments, hearing aid 202A, hearing aid 202B, and remote device 210 can be synchronized devices. For example, hearing aid 202A, hearing aid 202B, and remote device 210 can include synchronized sampling clocks for processing the first microphone signal, the second microphone signal, and the remote microphone signal. In other embodiments, instead of synchronizing the sample clocks, microphone signals can be resampled relative to another microphone signal. For example, the first and second microphone signals can be resampled relative to the remote microphone signal.

Control circuitry 106, including its various embodiments, can be implemented in controllers 206A and 206B. Thus, in various embodiments, controllers 206A and 206B can receive the first microphone signal, the second microphone signal, and the remote microphone signal and calculate the first and second gains each as a function of the first microphone signal, the second microphone signal, and the remote microphone signal. In various embodiments, various wireless communication links can be used to route the first microphone signal, the second microphone signal, and the remote microphone signal to one or both of controllers 206A and 206B.

Figure 3:
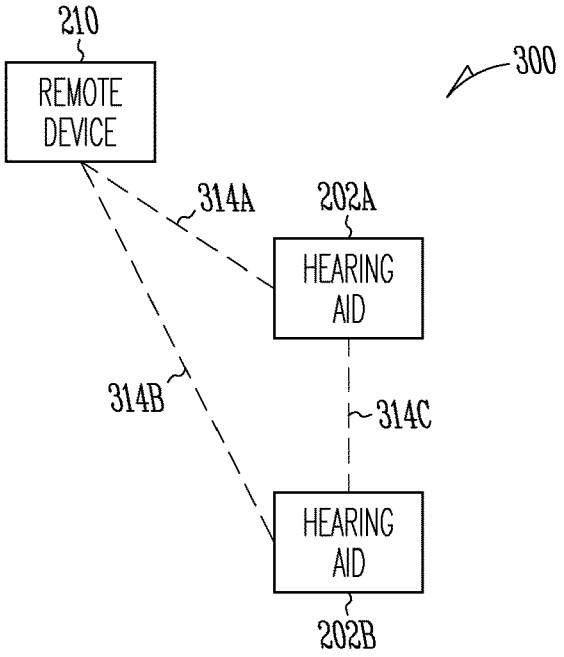
FIG. 3 is a block diagram illustrating of an exemplary embodiment of wireless communication links in a hearing system.

FIG. 3 is a block diagram illustrating of an exemplary embodiment of wireless communication links in a hearing assistance system 300. System 300 represents an exemplary embodiment of system 200 with wireless communication links 114 being implemented as wireless communication lines 314A-C. Wireless communication link 314A is coupled between remote device 210 and hearing aid 202A. Wireless communication link 314B is coupled between remote device 210 and hearing aid 202B. Wireless communication link 314C is coupled between aid 202A and hearing aid 202B. Remote communication circuit 218 can transmit the remote microphone signal to hearing aid 202A via wireless communication link 314A, and transmit the remote microphone signal to hearing aid 202B via wireless communication link 314B. Communication circuit 216A can transmit the first microphone signal to hearing aid 202B via wireless communication link 314C. Communication circuit 216B can transmit the second microphone signal to hearing aid 202A via wireless communication link 314C. Controller 206A can calculate the first gain as a first function of the first microphone signal, the second microphone signal, and the remote microphone signal. Controller 206B can calculate the second gain as a second function of the first microphone signal, the second microphone signal, and the remote microphone signal. In various embodiments, the first function and the second function are identical functions, and hence, the first gain and the second gain have equal values. In other embodiments, the first function and the second function are different functions, and hence, the first gain and the second gain may have different values.

Figure 4:
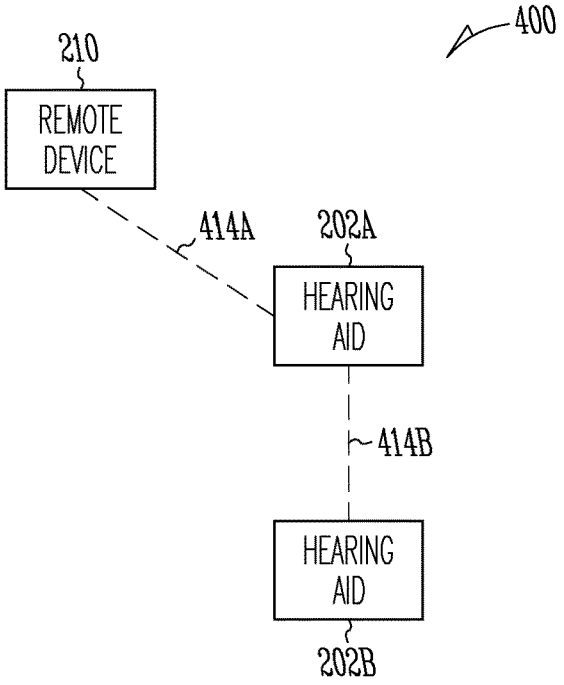
FIG. 4 is a block diagram illustrating of another exemplary embodiment of wireless communication links in a hearing system.

FIG. 4 is a block diagram illustrating of an exemplary embodiment of wireless communication links in a hearing assistance system 400. System 400 represents another exemplary embodiment of system 200 with wireless communication links 114 being implemented as wireless communication lines 414A-B. Wireless communication link 414A is coupled between remote device 210 and hearing aid 202A. Wireless communication link 414B is coupled between hearing aid 202A and hearing aid 202B. Remote communication circuit 218 can transmit the remote microphone signal to hearing aid 202A via wireless communication link 414A. In an exemplary embodiment, communication circuit 216A can transmit the first microphone signal and the remote microphone signal to hearing aid 202B via wireless communication link 414B. Communication circuit 216B can transmit the second microphone signal to hearing aid 202A via wireless communication link 414B. Controller 206A can calculate the first gain as a first function of the first microphone signal, the second microphone signal, and the remote microphone signal. Controller 206B can calculate the second gain as a second function of the first microphone signal, the second microphone signal, and the remote microphone signal. In another exemplary embodiment, communication circuit 216B transmits the second microphone signal to hearing aid 202A via wireless communication link 414B. Controller 206A can calculate the first gain as a first function of the first microphone signal, the second microphone signal, and the remote microphone signal. Controller 206A can further calculate the second gain as a second function of the first microphone signal, the second microphone signal, and the remote microphone signal. Communication circuit 216A then can transmit the second gain to hearing aid 202B via wireless communication link 414B. In various embodiments, the first function and the second function are identical functions, and hence, the first gain and the second gain have equal values. In other embodiments, the first function and the second function are different functions, and hence, the first gain and the second gain may have different values.

Figure 5:
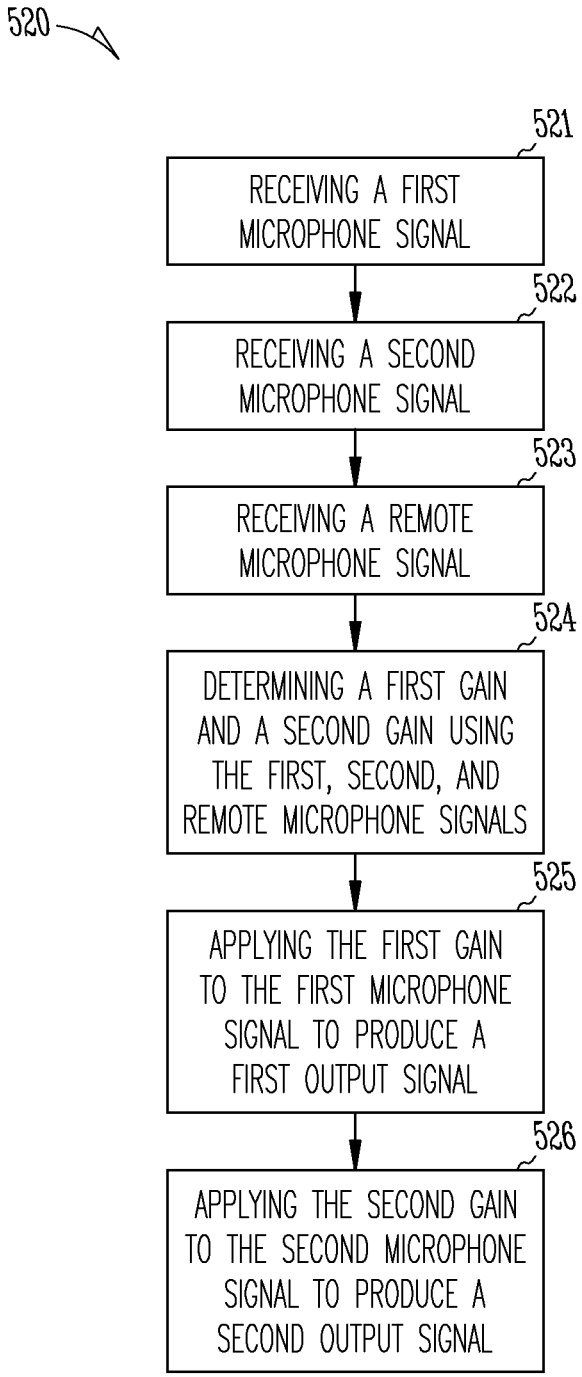
FIG. 5 is a flow chart illustrating an exemplary embodiment of a method for improving speech intelligibility in a pair of hearing devices using a remote microphone.

FIG. 5 is a flow chart illustrating an exemplary embodiment of a method 520 for improving speech intelligibility in a pair of hearing devices using a remote microphone. In an exemplary embodiment, control circuitry 106, which may be implemented in controllers 206A and 206B, is programmed to perform method 520.

At 521, a first microphone signal is received from a first microphone (e.g., microphone 204A) in a first hearing device (e.g., hearing aid 202A) of the pair of hearing devices. At 522, a second microphone signal is received from a second microphone (e.g., microphone 204B) in a second hearing device (e.g., hearing aid 202B) of the pair of hearing devices. At 523, a remote microphone signal is received from a remote device (e.g., remote device 210) wirelessly coupled to the pair of hearing devices.

At 524, a first gain and a second gain are determined based on the first microphone signal, the second microphone signal, and the remote microphone signal. In various embodiments, a common gain is calculated as the first gain and the second gain. The first microphone signal and the second microphone signal are each filtered using a WOLA filter bank before the common gain is applied. In an exemplary embodiment, the common gain is calculated using the equation:

$$G_A = \frac{2|Y|}{|Z_1| + |Z_2|},$$

where $G_A$ is the common gain, $Z_1$ is the first microphone signal, $Z_2$ is the second microphone signal, and Y is the remote microphone signal. The rationale is that $G_A$ minimizes $(|Y|-G_A|Z_1|)+(|Y|-G_A|Z_2|)$. In another exemplary embodiment, the common gain is calculated using the equation:

$$G_B = \frac{|Y|}{\sqrt{|Z_1||Z_2|}},$$

where $G_A$ is the common gain, $Z_1$ is the first microphone signal, $Z_2$ is the second microphone signal, and Y is the remote microphone signal. The rationale is that $G_B$ minimizes $(\log|Y|-\log G_B|Z_1|)+(\log|Y|-\log G_B|Z_2|)$. The calculation of $G_A$ is less expensive than that of $G_B$ (which contains a square-root as well).

At 525, the first gain is applied to the first microphone signal to produce a first output signal. At 526, the second gain is applied to the second microphone signal to produce a second output signal. In various embodiments, the first gain can be applied to the WOLA-filtered first microphone signal, and the second gain can be applied to the WOLA-filtered second microphone signal. In an exemplary embodiment, the gain ($G_A$ or $G_B$) is one-pole averaged (time-smoothed) and used as the first gain that is directly applied to the WOLA-filtered first microphone signal and the second gain that is directly applied to the WOLA-filter second microphone signal. When the gain $G_A$ is used, for example, the first output signal is:

$$\widehat{X_1} = \frac{2|Y|}{|Z_1| + |Z_2|} Z_1,$$

and the second output signal is:

$$\widehat{X_2} = \frac{2|Y|}{|Z_1| + |Z_2|} Z_2.$$

Because the gain is real-valued and the same at both ears of the listener, the interaural time and level differences can be preserved. The gain is strictly dependent on the magnitude spectra of the microphone signals. This means that a tight, 3-way sampling-clock synchronization is not expected to be crucial.

Transmission delay in the three-microphone network may have minimal effect in the various embodiments as discussed above. The overall delay of the three-microphone system is D seconds, that is, it takes D seconds for all of the first microphone signal, the second microphone signal, and the remote microphone signals to be available for processing by control circuitry 106. If there is enough memory to buffer D seconds-worth of the WOLA-filtered first and second microphone signals, then the gains $G_A$ and $G_B$ can each be calculated based on the most recent set of the available first, second, and remote microphone signals but applied immediately to latest WOLA-filtered first and second microphone signals, so that no delay effect is incurred. This method is viable provided a reasonable amount of delay is observed. Simulations have shown that a delay below 50 milliseconds produces nearly unperceivable distortion in sounds produced based on the first and second output signals, while improvements in speech intelligibility are retained. At a delay of 100 milliseconds or more, a disturbing echo-like effect is present.

Figure 6:
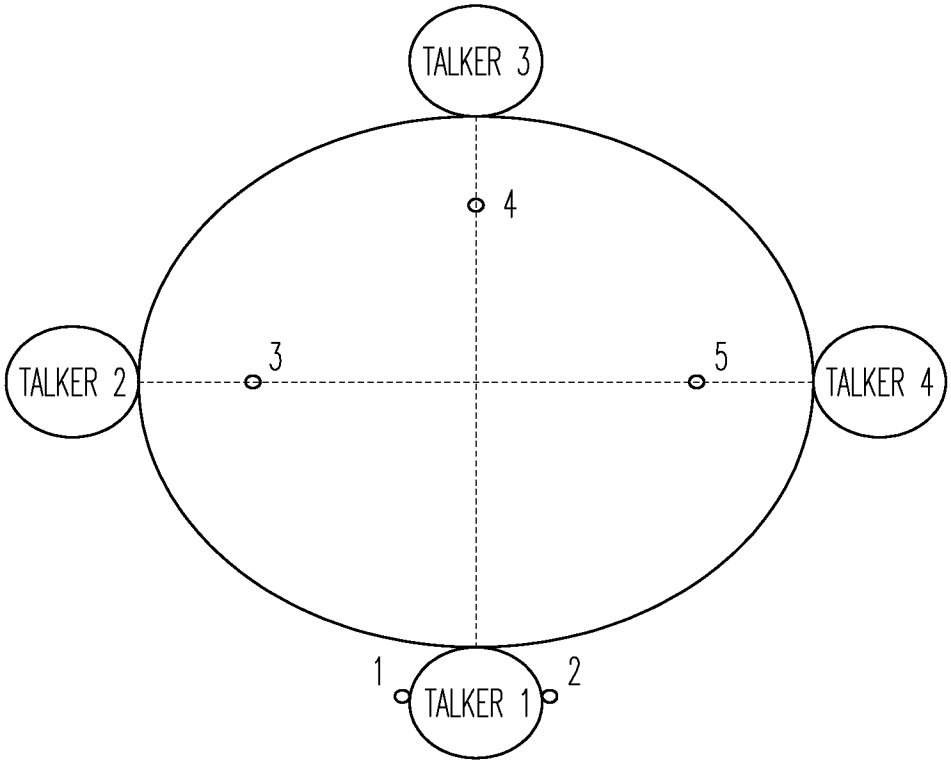
FIG. 6 is an illustration of a microphone setup used for evaluating improvement of speech intelligibility for a pair of hearing aids using a remote microphone.

FIG. 6 illustrates an experimental setup of microphones. The illustrated experimental setup was used to conduct a recording session to form a database of signals for use in designing and evaluating ad-hoc microphone array signal processing algorithms. Microphones 1-5 (small circles in FIG. 6) were positioned in various locations, as illustrated in FIG. 6, at a central table with target talkers 1-4 at the table. To evaluate improvement of speech intelligibility for a pair of hearing aids using a remote microphone according to the present subject matter, experiments were conducted using the recordings of microphones 1-5 as explained below.

In one experiment, the listener is talker 1, microphone 1 is the first microphone that produces the first microphone signal, and microphone 2 is the second microphone that produces the second microphone signal. Three cases in high babble levels are tested with 12 listeners (subjects with normal hearing), with results summarized in Table 1:

(1) microphone 3 is the remote microphone that produces the remote microphone signal (condition "L" for Left), and listener are instructed to focus on the left speaker (talker 2);

(2) microphone 4 is the remote microphone that produces the remote microphone signal (condition "C" for Center), and listener are instructed to focus on the front speaker (talker 3); and (3) microphone 5 is the remote microphone that produces the remote microphone signal (condition "R" for Right), and listener are instructed to focus on the right speaker (talker 4).

TABLE 1

| Condition | Prefer On | Prefer Off |
|---|---|---|
| L | 11 | 1 |
| C | 10 | 2 |
| R | 11 | 1 |

The effect was strong and obvious enough to the listener that it did not require an explanation to the listeners of which talker was being enhanced. The question to the listeners was: Assuming you are trying to follow the left/center/right speaker, would you prefer the proposed feature to be On or Off? The result showing the number of listeners who preferred On and the number of listeners who preferred Off for each condition is presented in Table 1.

For this experiment, the algorithm to be executed by control circuitry 106 was simulated such that:

1. The remote microphone signal and the contralateral signal were only available to the hearing aids for 30 milliseconds after they were captured;
2. The sampling rate was 20 kHz;
3. There were 16 filter bands;
4. The three sampling clocks (the two hearing aids and the remote device) are ideally synchronized; and
5. The smoothing factor (one-pole averaging) for the gain was 0.95.

The majority of 12 listeners pointed out intelligibility improvements (with the target found to be easier to follow, and the background noise sounding attenuated), especially for the L and R conditions.

Hearing devices typically include at least one enclosure or housing, a microphone, hearing device electronics including processing electronics, and a speaker or "receiver." Hearing devices may include a power source, such as a battery. In various embodiments, the battery may be rechargeable. In various embodiments, multiple energy sources may be employed. It is understood that in various embodiments the microphone is optional. It is understood that in various embodiments the receiver is optional. It is understood that variations in communications protocols, antenna configurations, and combinations of components may be employed without departing from the scope of the present subject matter. Antenna configurations may vary and may be included within an enclosure for the electronics or be external to an enclosure for the electronics. Thus, the examples set forth herein are intended to be demonstrative and not a limiting or exhaustive depiction of variations.

It is understood that digital hearing aids include a processor. For example, control circuitry 106A-B or controllers 206A-B may each be implemented in such a processor. In digital hearing aids with a processor, programmable gains may be employed to adjust the hearing aid output to a wearer's particular hearing impairment. The processor may be a digital signal processor (DSP), microprocessor, microcontroller, other digital logic, or combinations thereof. The processing may be done by a single processor, or may be distributed over different devices. The processing of signals referenced in this application can be performed using the processor or over different devices. Processing may be done in the digital domain, the analog domain, or combinations thereof. Processing may be done using subband processing techniques. Processing may be done using frequency domain or time domain approaches. Some processing may involve both frequency and time domain aspects. For brevity, in some examples drawings may omit certain blocks that perform frequency synthesis, frequency analysis, analog-to-digital conversion, digital-to-analog conversion, amplification, buffering, and certain types of filtering and processing. In various embodiments the processor is adapted to perform instructions stored in one or more memories, which may or may not be explicitly shown. Various types of memory may be used, including volatile and nonvolatile forms of memory. In various embodiments, the processor or other processing devices execute instructions to perform a number of signal processing tasks. Such embodiments may include analog components in communication with the processor to perform signal processing tasks, such as sound reception by a microphone, or playing of sound using a receiver (i.e., in applications where such transducers are used). In various embodiments, different realizations of the block diagrams, circuits, and processes set forth herein can be created by one of skill in the art without departing from the scope of the present subject matter.

Various embodiments of the present subject matter support wireless communications with a hearing device. In various embodiments the wireless communications can include standard or nonstandard communications. Some examples of standard wireless communications include, but not limited to, Bluetooth™, low energy Bluetooth, IEEE 802.11 (wireless LANs), 802.15 (WPANs), and 802.16 (WiMAX). Cellular communications may include, but not limited to, CDMA, GSM, ZigBee, and ultra-wideband (UWB) technologies. In various embodiments, the communications are radio frequency communications. In various embodiments the communications are optical communications, such as infrared communications. In various embodiments, the communications are inductive communications. In various embodiments, the communications are ultrasound communications. Although embodiments of the present system may be demonstrated as radio communication systems, it is possible that other forms of wireless communications can be used. It is understood that past and present standards can be used. It is also contemplated that future versions of these standards and new future standards may be employed without departing from the scope of the present subject matter.

The wireless communications support a connection from other devices. Such connections include, but are not limited to, one or more mono or stereo connections or digital connections having link protocols including, but not limited to 802.3 (Ethernet), 802.4, 802.5, USB, ATM, Fibre-channel, Firewire or 1394, InfiniBand, or a native streaming interface. In various embodiments, such connections include all past and present link protocols. It is also contemplated that future versions of these protocols and new protocols may be employed without departing from the scope of the present subject matter.

In various embodiments, the present subject matter is used in hearing devices that are configured to communicate with mobile phones. In such embodiments, the hearing device may be operable to perform one or more of the following: answer incoming calls, hang up on calls, and/or provide two way telephone communications. In various embodiments, the present subject matter is used in hearing devices configured to communicate with packet-based devices. In various embodiments, the present subject matter includes hearing devices configured to communicate with streaming audio devices. In various embodiments, the present subject matter includes hearing devices configured to communicate with Wi-Fi devices. In various embodiments, the present subject matter includes hearing devices capable of being controlled by remote control devices.

It is further understood that different hearing devices may embody the present subject matter without departing from the scope of the present disclosure. The devices depicted in the figures are intended to demonstrate the subject matter, but not necessarily in a limited, exhaustive, or exclusive sense. It is also understood that the present subject matter can be used with a device designed for use in the right ear or the left ear or both ears of the wearer.

The present subject matter may be employed in hearing devices, such as hearing aids, headsets, headphones, and similar hearing devices.

The present subject matter may be employed in hearing devices having additional sensors. Such sensors include, but are not limited to, magnetic field sensors, telecoils, temperature sensors, gyroscope, accelerometers and proximity sensors.

The present subject matter is demonstrated for hearing devices, including hearing aids, including but not limited to, behind-the-ear (BTE), in-the-ear (ITE), in-the-canal (ITC), receiver-in-canal (RIC), or completely-in-the-canal (CIC) type hearing aids. It is understood that behind-the-ear type hearing aids may include devices that reside substantially behind the ear or over the ear. Such devices may include hearing aids with receivers associated with the electronics portion of the behind-the-ear device, or hearing aids of the type having receivers in the ear canal of the user, including but not limited to receiver-in-canal (RIC) or receiver-in-the-ear (RITE) designs. The present subject matter can also be used in hearing assistance devices generally, such as cochlear implant type hearing devices. The present subject matter can also be used in deep insertion devices having a transducer, such as a receiver or microphone. The present subject matter can be used in devices whether such devices are standard or custom fit and whether they provide an open or an occlusive design. It is understood that other hearing devices not expressly stated herein may be used in conjunction with the present subject matter.

This application is intended to cover adaptations or variations of the present subject matter. It is to be understood that the above description is intended to be illustrative, and not restrictive. The scope of the present subject matter should be determined with reference to the appended claims, along with the full scope of legal equivalents to which such claims are entitled.

What is claimed is:

1. A hearing system, comprising:

a first hearing device including a first microphone configured to produce a first microphone signal; a second hearing device including a second microphone configured to produce a second microphone signal; a remote device configured to be communicatively coupled to the first hearing device via a first wireless communication link and communicatively coupled to the second hearing device via a second wireless communication link, the remote device including a remote microphone configured to produce a remote microphone signal; and control circuitry in the first and second hearing devices, the control circuitry configured to receive the first microphone signal, the second microphone signal, and the remote microphone signal, calculate a single gain using the first microphone signal, the second microphone signal, and the remote microphone signal, apply the same gain to the first microphone signal to produce a first output signal, and apply the same gain to the second microphone signal to produce a second output signal.

2. The hearing system of claim 1, wherein the first hearing device comprises a first hearing aid, the second hearing device comprises a second hearing aid, and the first hearing aid and the second hearing aid are communicatively coupled to each other via a third wireless communication link.

3. The hearing system of claim 2, wherein the first microphone and the second microphone have substantially matched response functions, and the remote microphone is calibrated or filtered to have a remote response function substantially matching the substantially matched response functions of the first microphone and the second microphone.

4. The hearing system of claim 3, wherein the first hearing aid, the second hearing aid, and the remote device are substantially synchronized for processing the first microphone signal, the second microphone signal, and the remote microphone signal.

5. The hearing system of claim 4, wherein the remote device is configured to wirelessly transmit the remote microphone signal, and the first hearing aid is configured to receive the remote microphone signal directly from the remote device and calculate the gain using the first microphone signal, the second microphone signal, and the remote microphone signal.

6. The hearing system of claim 5, wherein the second hearing aid is configured to receive the remote microphone signal directly from the remote device and calculate the gain using the first microphone signal, the second microphone signal, and the remote microphone signal.

7. The hearing system of claim 5, wherein the second hearing aid is configured to receive the calculated gain from the first hearing aid.

8. The hearing system of claim 1, wherein the control circuitry is configured to calculate the gain using a function:

$$G_A = \frac{2|Y|}{|Z_1| + |Z_2|},$$

wherein $G_A$ is the gain, $Z_1$ is the first microphone signal, $Z_2$ is the second microphone signal, and Y is the remote microphone signal.

9. The hearing system of claim 1, wherein the control circuitry is configured to calculate the gain using a function:

$$G_B = \frac{|Y|}{\sqrt{|Z_1||Z_2|}},$$

wherein $G_B$ is the gain, $Z_1$ is the first microphone signal, $Z_2$ is the second microphone signal, and Y is the remote microphone signal.

10. The hearing system, comprising:

a first hearing aid including:

a first microphone configured to receive a first sound and produce a first microphone signal using the first sound;

a first controller configured to calculate a first gain and to produce a first output signal by applying the first gain to the first microphone signal, the first gain being a first gain function of the first microphone signal, a second microphone signal, and a remote microphone signal;

a first receiver to configured produce a first output sound using the first output signal; and a first communication circuit configured to receive the second microphone signal and the remote signal;

a second hearing aid wirelessly coupled to the first hearing device and including:

a second microphone configured to receive a second sound and produce a second microphone signal using the second sound;

a second controller configured to calculate a second gain and to produce a second output signal b applying the second gain to the second microphone signal, the second gain being a second gain function of the first microphone signal, the second microphone signal, and the remote microphone signal;

a second receiver to configured produce a second output sound using the second output signal; and a second communication circuit configured to receive the first microphone signal and the remote signal; and a remote device wirelessly coupled to the first and second hearing aids and including:

a remote microphone configured to receive a remote sound and produce the remote microphone signal using the remote sound; and a remote communication circuit configured to transmit the remote microphone signal, wherein the first microphone has a first response function being a ratio of the first microphone signal to the first sound, the second microphone has a second response function being a ratio of the second microphone signal to the second sound, the first response function and the second response function are substantially matched response functions, and the remote microphone is calibrated or filtered to have a remote response function substantially matching the substantially matched first and second response functions.

11. The hearing system of claim 10, wherein the first hearing aid, the second hearing aid, and the remote device are substantially synchronized for processing the first microphone signal, the second microphone signal, and the remote microphone signal.

12. The hearing system of claim 11, wherein the first controller and the second controller are configured to use a common gain function as the first gain function and the second gain function.

13. A method for operating a pair of first and second hearing assistance devices, comprising:

receiving a first microphone signal from a first microphone in the first hearing device;

receiving a second microphone signal from a second microphone in the second hearing device;

receiving a remote microphone signal from a remote device wirelessly coupled to the pair of first and second hearing assistance devices;

applying the first gain to the first microphone signal to produce a first output signal; and applying the second gain to the second microphone signal to produce a second output signal.

14. The method of claim 13, comprising filtering the first microphone signal using a first weighted overlap-add (WOLA) filter bank and filtering the second microphone signal using a second WOLA filter bank, and wherein applying the first gain to the first microphone signal comprises applying the first gain to the filtered first microphone signal, and applying the second gain to the second microphone signal comprises applying the second gain to the filtered second microphone signal.

15. The method of claim 14, wherein determining the first and the second gain comprises calculating the first gain and the second gain using a common gain function.

16. The method of claim 15, wherein the common gain function is $$G_A = \frac{2|Y|}{|Z_1| + |Z_2|},$$

wherein $G_A$ is the gain, $Z_1$ is the first microphone signal, $Z_2$ is the second microphone signal, and Y is the remote microphone signal.

17. The method of claim 15, wherein the common gain function is $$G_B = \frac{|Y|}{\sqrt{|Z_1||Z_2|}},$$

wherein $G_B$ is the gain, $Z_1$ is the first microphone signal, $Z_2$ is the second microphone signal, and Y is the remote microphone signal.

18. The method of claim 13, comprising synchronizing clocks in the first hearing assistance device, the second hearing assistance device, and the remote device.

19. The method of claim 13, wherein receiving the remote microphone signal from the remote device comprises receiving the remote microphone signal from a cellphone.

20. The method of claim 19, wherein receiving the first microphone signal comprises receiving the first microphone signal from the first microphone in a first hearing aid, and receiving the second microphone signal comprises receiving the second microphone signal from the second microphone in a second hearing aid.

* * * * *